United States Patent [19]

Morris et al.

[11] 4,141,413

[45] Feb. 27, 1979

[54] HYDRAULIC ACTUATED WEIGHT SET WELL PACKER

[75] Inventors: Arthur J. Morris, Magnolia; James K. Garner, Jr., Houston, both of Tex.

[73] Assignee: Camco, Incorporated, Houston, Tex.

[21] Appl. No.: 863,297

[22] Filed: Dec. 22, 1977

[51] Int. Cl.[2] ..... E21B 23/04; E21B 33/129

[52] U.S. Cl. ..... 166/120; 166/196; 166/212

[58] Field of Search ..... 166/120, 212, 196, 202, 166/134, 313

[56] References Cited

U.S. PATENT DOCUMENTS

| | | | |
|---|---|---|---|
| 2,435,899 | 2/1948 | Page | 166/212 |
| 2,467,801 | 4/1949 | Baker | 166/120 |
| 2,624,409 | 1/1953 | O'Neill | 166/212 X |
| 2,764,243 | 9/1956 | Page | 166/120 X |
| 3,080,923 | 3/1963 | Brown | 166/120 |
| 3,224,508 | 12/1965 | Cochran | 166/120 |
| 3,288,219 | 11/1966 | Young et al. | 166/120 |
| 3,414,058 | 12/1968 | Rochemont | 166/120 |

OTHER PUBLICATIONS

TIW (Texas Iron Works) Catalog 76–77, pp. 5552 and 5553.

*Primary Examiner*—Stephen J. Novosad
*Attorney, Agent, or Firm*—Fulbright & Jaworski

[57] ABSTRACT

A well packer for connection in a well tubing in a well in which the body has an internal diameter as great as the tubing in which it is to be inserted and has a tensile strength greater than the tubing. Packing surrounds the body and a longitudinally movable expander is positioned about the body and below the packing and is movable towards the packing for expanding the packing outwardly. Slips are positioned about the body and adjacent the lower end of the expander means and move outwardly upon movement of the slips towards the expander. An annular piston positioned about the body is longitudinally movable and on upward movement expands the slips and the packing. An annular spring is positioned above the piston and yieldably urges the piston in a downward direction whereby the packer may be set, released from a set position, and reset in the well.

5 Claims, 11 Drawing Figures

Fig. 1C
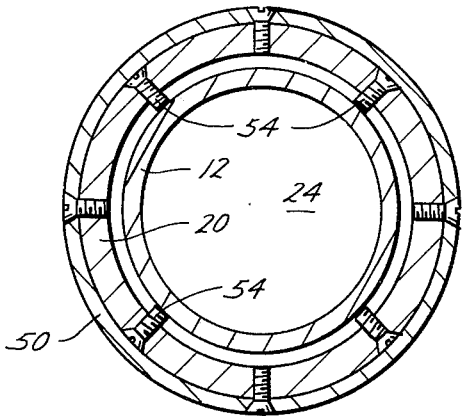
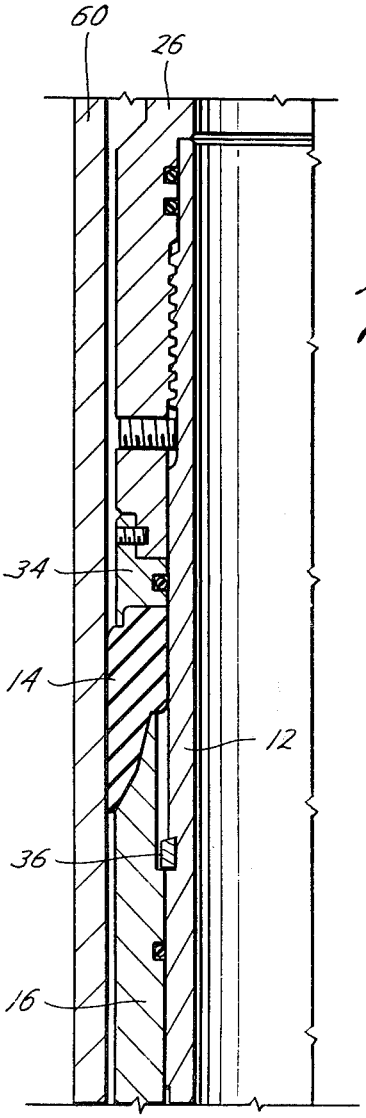
Fig. 2A
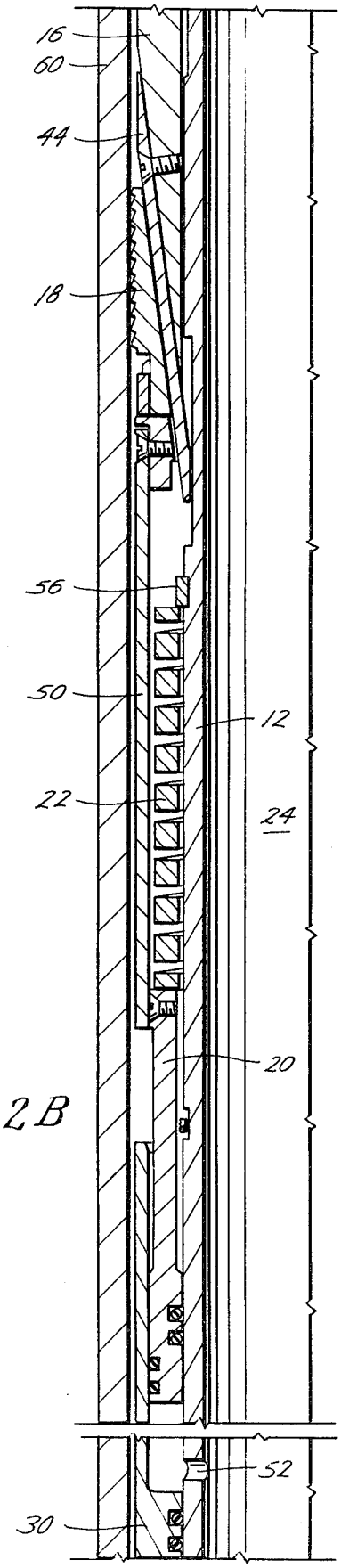
Fig. 2B

HYDRAULIC ACTUATED WEIGHT SET WELL PACKER

BACKGROUND OF THE INVENTION

The present invention is directed to an improved single or multiple bore packer which is simple in design, has a production bore equal to the bore of the well tubing in which it is connected, and has an integral body providing a tensile strength exceeding the strength of the tubing. The packer is hydraulically actuated and weight set for actuating both the slips and the packing and can be repositioned without the necessity of removing the tubing string.

SUMMARY

The present apparatus is directed to a single or multiple bore well packer for connection in a well tubing. One feature of the present packer is the use of an integral body having an internal diameter as great as the tubing into which it is to be inserted and having a tensile strength greater than the tubing.

Another feature of the present invention is the provision of packing means surrounding the body with a longitudinal movable expander positioned below the packing means for expanding the packing means outwardly on relative movement of the expander means towards the packing means. Slip means are positioned about the body adjacent the lower end of the expander means and coacting wedge surfaces between the expander means and both the packing means and slip means expand the packer means and slip means outwardly as the slip means moves towards the expander means. Piston means is positioned about the body and is longitudinally movable on the body whereby upward movement of the piston expands the slip means and the packing means for actuating the packer. The setting of the packer may be completed by releasing the weight of the tubing. Port means are provided in the body for providing a fluid passageway between the interior of the body and the bottom of the piston for actuating the piston. Yieldable urging means, such as a spring, is in engagement with the piston for urging the piston in a downwardly direction for allowing the packer to be set, released from a set position, and reset in the well.

Still a further object of the present invention is the provision of stop means between the expander and the body for controlling the extent of longitudinal movement of the expander relative to the body for insuring a proper relationship between the expansion of the packing means and the slip means.

Other and further objects, features and advantages will be apparent from the following description of presently preferred embodiments of the invention, given for the purposes of disclosure and taken in conjunction with the accompanying drawings.

BRIEF DESCRIPTION OF THE DRAWINGS

FIG. 1C is a cross-sectional view taken along the line 1C—1C of FIG. 1B, FIGS. 2A and 2B are continuations of each other of a fragmentary quarter section view of the packer of FIGS. 1A and 1B shown in the set position.

DESCRIPTION OF THE PREFERRED EMBODIMENT

Figure 1A:
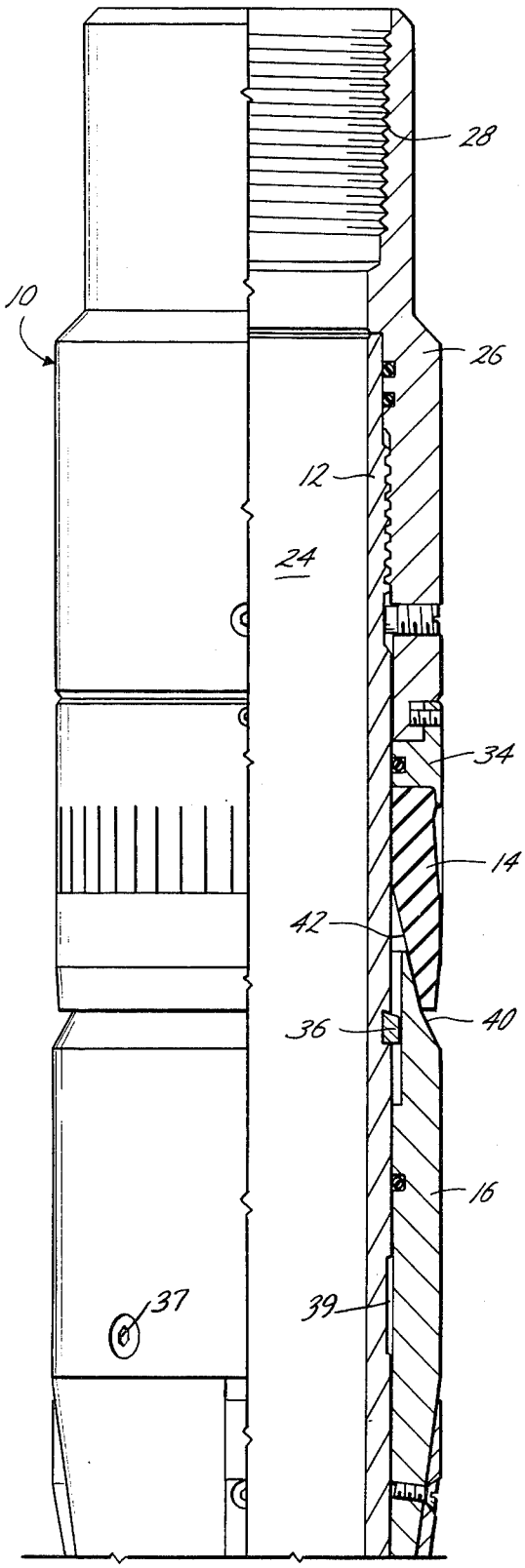
FIGS. 1A and 1B are continuations of each other illustrating an elevational view, partly in cross section, of a single bore packer according to the present invention in a retracted position.
Figure 1B:
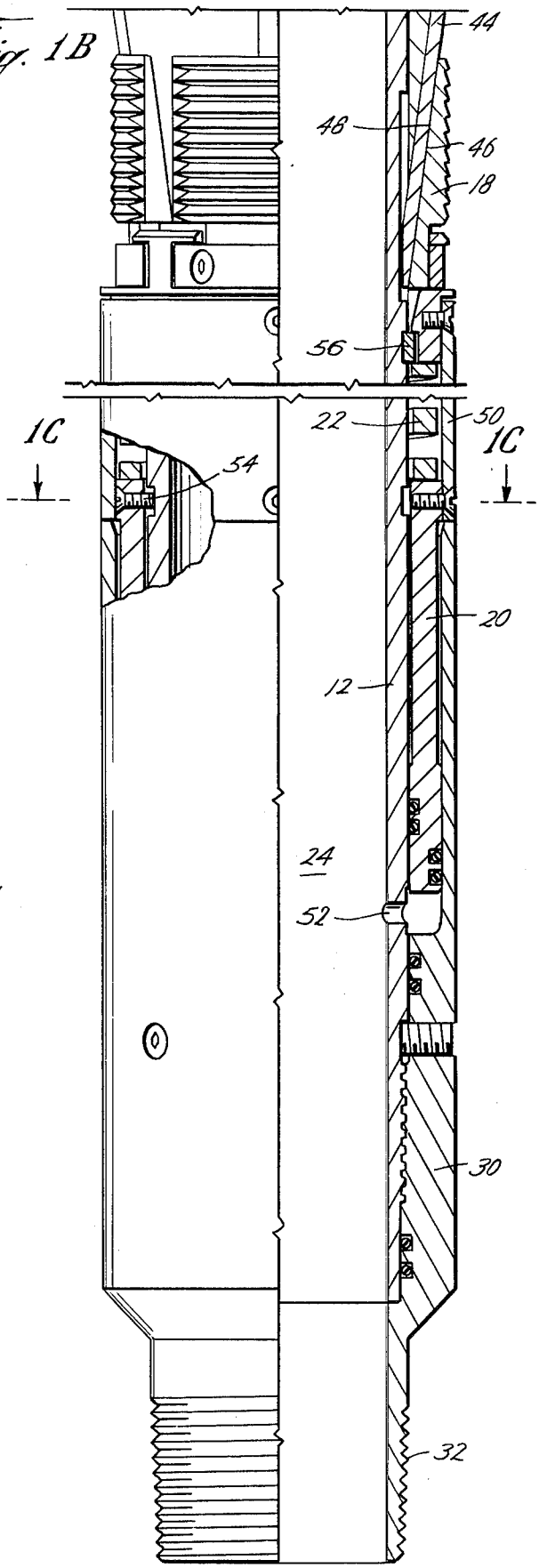
Figure 3A:
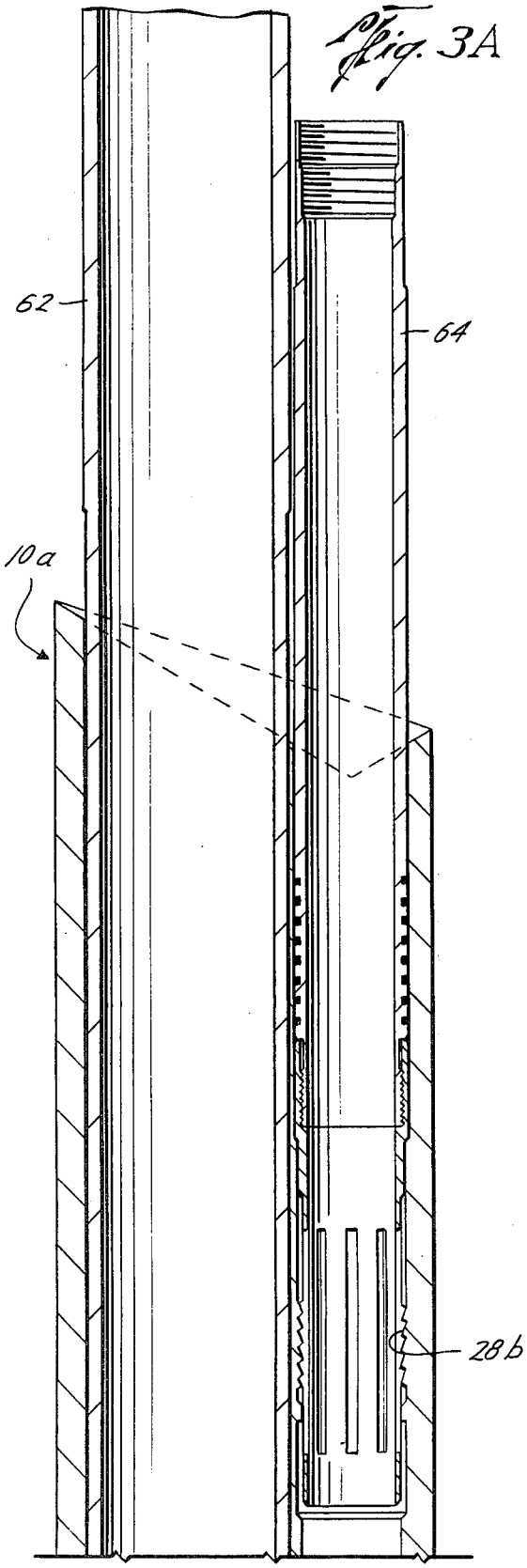
FIGS. 3A, 3B and 3C are continuations of each other of an elevational view of a multiple bore packer, in cross section, and shown in the retracted position.

Referring now to the drawings and particularly to FIGS. 1A and 1B, the well packer of the present invention is generally indicated by the reference numeral 10 and generally includes a body 12, packing means 14, a movable expander 16, slip means 18, piston means 20, and yieldable urging means 22.

The body 12 is preferably an integral tubular member having an internal diameter as great as the internal diameter of the tubing into which the packer 10 is to be connected thereby providing a large production bore 24 through the packer 10. The integral body 12 is of a tensile strength which exceeds the strength of the tubing in which the packer 10 is connected whereby the packer 10 maintains its strength integrity under adverse conditions. A top sub 26 is threadably connected to the top of the body 12 and is in turn provided with threaded connections 28 for connection in a string of well tubing. Similarly, a bottom sub 30 is threadably connected to the bottom of the body 12 and includes threads 32 for connection of the bottom of the packer 10 into a string of well tubing.

The packing means 14 surrounds the body 12 and preferably is a cup-type resilient seal of any suitable material such as nitrile elastomer. The packing means 14 may include a ring 34 securely holding the upper end of the resilient cup packer to the exterior of the body 12.

The expander means 16 is positioned below the packing means 14 about the body 12 and is mounted on the body for limited longitudinal movement in an upward direction by a snap ring 36 and in a lower direction by pins 37 engaging groove 39. Coacting wedge surfaces 40 and 42 on the packing 14 and the expander 16, respectively, insure that the packing means 14 will be expanded outwardly on relative movement of the expander means 16 towards the packing means 14.

Figure 4:
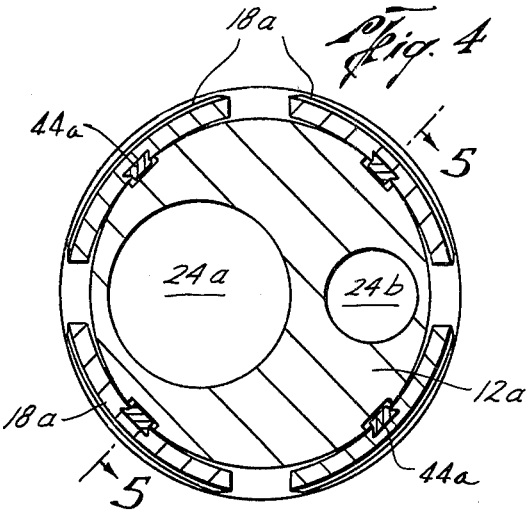
FIG. 4 is a cross-sectional view taken along the line 4—4 of FIG. 3B.
Figure 5:
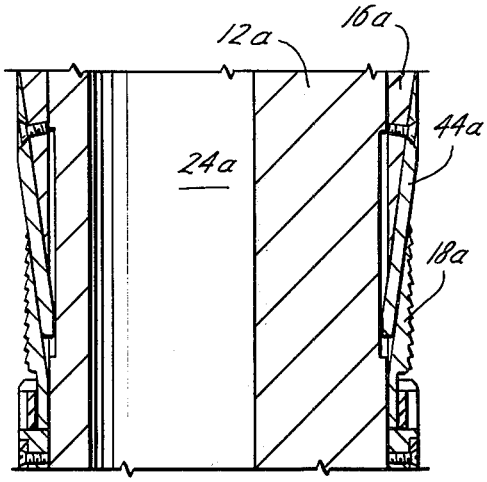
FIG. 5 is a cross-sectional view taken along the line 5—5 of FIG. 4.
Figure 6:
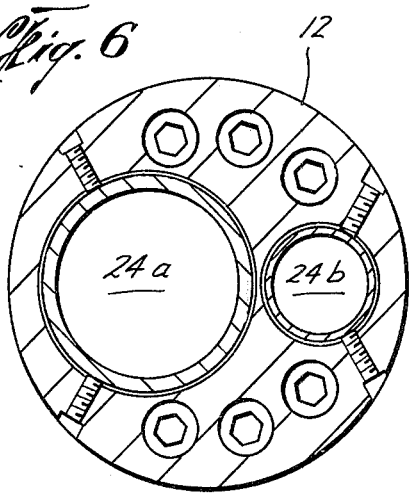
FIG. 6 is a cross-sectional view taken along the line 6—6 of FIG. 3C.
Figure 3B:
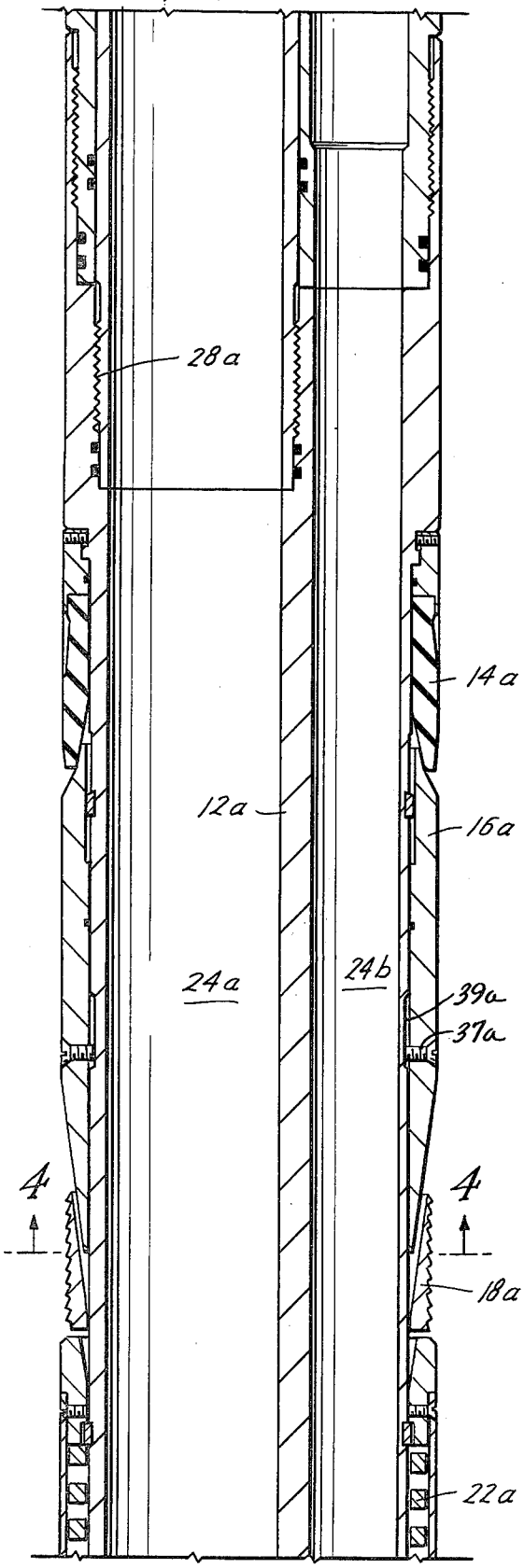
Figure 3C:
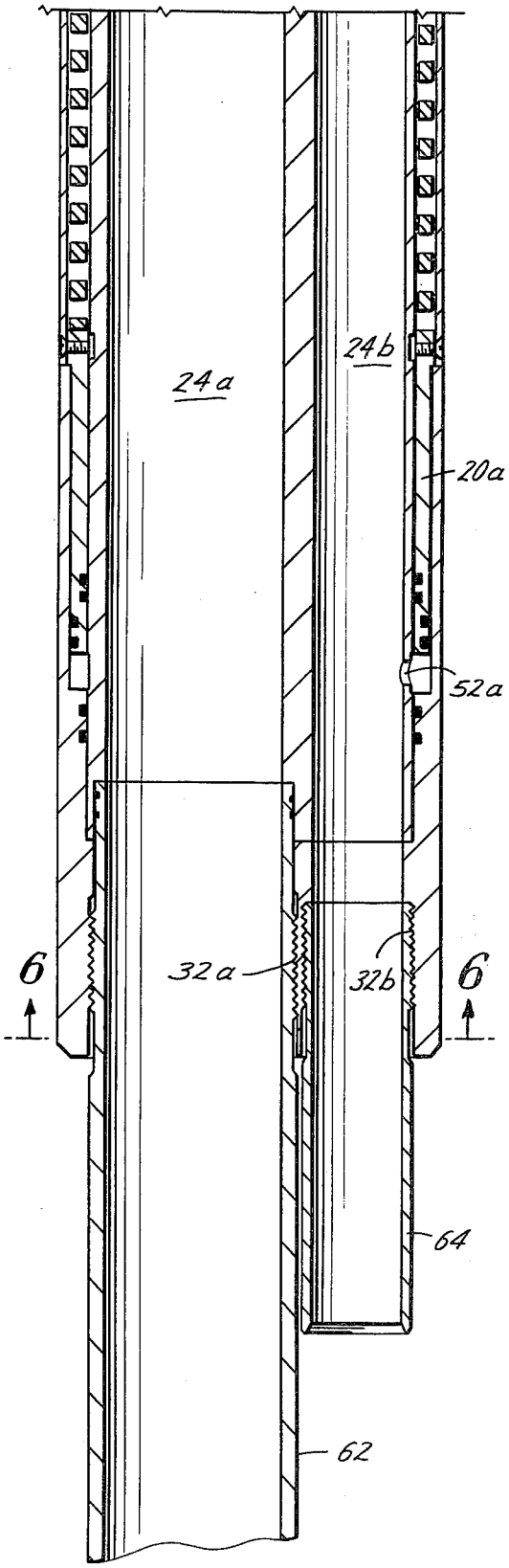

Slip means 18 may include a plurality of slip segments positioned about the body 12 and adjacent the lower end of expander means 16 such as being connected to a slip keeper 44 by a dovetailed connection similar to that shown in FIG. 4 in connection with the description of the dual packer which will be presently described. Coacting wedge surfaces 46 and 48 between the lower end of the expander means 16 and the slip means 18, respectively, are provided for expanding the slip means 18 outwardly upon relative movement of the slip means 18 towards the expander means 16.

Annular piston means 20 are provided in the bottom sub 30 and is connected to the slip means 18 and is longitudinally movable on the body 12 whereby upward movement of the piston 20 in housing 50 expands the slip means 18 and the packing means 14. Port means 52 are provided in the body 12 to provide a fluid passageway between the bore 24 of the body and the bottom of the piston 20 whereby the piston may be actuated upwardly by the application of fluid pressure in the bore 24 of the body 12. Preferably, a plurality of shear pins 54, best seen in FIGS. 1B and 1C, are provided between the piston 20 and the body 12 for initially holding the piston 20 in the retracted position for preventing inadvertent setting of the packer until the desired position is reached. In addition, means are provided for yieldably urging the piston 20 to a downward position, such as spring 22 whose upper end rests against a stop such as a snap ring 56 and whose bottom end acts against the piston 20 for yieldably urging the piston 20, slips 18 and expander 16 into a retracted position for releasing the packer from a set position where it may be removed from the well or reset in another position in the well.

In use, the packer 10 is run into the well with the parts in position shown in FIGS. 1A, 1B and 1C. When the packer 10 reaches the desired position in a casing 60 in the well, fluid pressure is applied to the bore 24 and pressure applied through the ports 52 to the bottom of the piston 20 such as 1500 psi. When a pressure drop is noted in the pressure of the fluid applied to the bore 24, the shear pins 54 will have sheared. Pressure in the bore 24 is continued until a predetermined increase in pressure is obtained, such as 1500 psi and at this time the piston 20 will have driven the slips 18 upwardly on the expander 16 and also move the expander 16 upwardly to move the packing means outwardly. The tubing weight is then released thereby moving the body 12 downwardly relative to the expander 16 to hold or fully set the packer slips 18 and the packing means 14 as best seen in FIGS. 2A and 2B. Retrieval of the packer 10 from the well is accomplished by simple upward pull on the tubing string whereby the slips 18 are moved away from the expander 16, the spring 22 retracts the piston 22, the slips 18 and expander 16 from the seal means 14 and the elements are then in a retracted position for removal from the well. In addition, the packer 10 may be repositioned to another place in the casing 60 by picking up on the tubing string to relieve the weight of the tubing on the packer slips 18 and the sealing means 14 sufficiently to allow the spring 22 to retract the slips 18 from the casing wall 60 to release the packer. The packer 10 is then repositioned to the desired position and pressurized to reset the slips 18 and seal means 14 and the tubing weight is again released to fully set the slips 18 and sealing element 14.

The packer 10 shown in FIGS. 1A, 1B, 1C, 2A and 2B is a single-bore packer. The present invention is also applicable for use with a multiple bore packer such as shown in FIGS. 3A, 3B, 3C, 4, 5 and 6 in which parts corresponding to those of the single-bore packer 10 are similarly numbered with the addition of the suffix "a". The multiple-bore packer **10*a*, here shown as having two bores 24*a* and 24*b* positioned in the body 12*a*. The body 12*a* includes tubing connections to each bore at each end of the body 12*a*. Thus, threads 28*a* in bore 24*a* are adapted to receive tubing 62 and teeth 28*b* (FIG. 3A) about bore 24*b* are adapted to receive tubing 64. At the bottom of the body 12*a*, threads 32*a* are adapted to receive a continuation of tubing 62 and threads 32*b* are adapted to receive a continuation of tubing 64. The packer 10*a* includes packing means 14*a*, an expander 16*a*, slip means 18*a*, piston 20*a* and yieldably urging means 22*a*, all similar in function and operation as previously described in connection with packer 10. As indicated in FIG. 4, the slip means 18*a* is connected to the body 12*a* by a slip keeper dovetail rail 44*a* whereby the slip means 18*a* may be longitudinally moved over the expander means 16*a*. The piston 20*a* may be suitably actuated through a port 52*a* to either or both of the bores 24*a* or 24*b*, here shown as being in communication with bore 24*b* for suitable actuation of the piston 20*a*. The packer 10*a* may be set, retrieved, or repositioned similar to the operation described in connection with packer 10*a***.

The present invention, therefore, is well adapted to carry out the objects and attain the ends and advantages mentioned as well as others inherent therein. While the presently preferred embodiment of the invention has been given for the purposes of disclosure, numerous changes in the details of construction and arrangement of parts will readily suggest themselves to those skilled in the art and which are encompassed within the spirit of the invention and the scope of the appended claims.

What is claimed is:

1. A well packer for connection in a well tubing comprising, a body, packing means surrounding said body, expander means positioned below said packing means and surrounding said body and longitudinally movable on said body, said body including a stop limiting the upward movement of the expander means, coacting wedge surfaces between the lower end of the packing means and the upper end of the expander means for expanding the packing means outwardly upon relative movement of the expander means towards the packing means, slip means positioned about the body and adjacent the lower end of the expander means, second coacting wedge surfaces between said expander means and said slip means for expanding the slip means outwardly upon relative movement of the slip means towards the expander means, piston means positioned about the body and longitudinally movable on said body whereby upward movement of the piston expands the slip means and said packing means, port means in the body providing a fluid passageway between the interior of the body and the bottom of the piston whereby the piston may be actuated upwardly by the application of fluid pressure, and means in engagement with said piston means yieldably urging said piston means in a downwardly direction.

2. A well packer for connection in a well tubing comprising, a body, a tubular member having an internal diameter as great as the tubing in which it is to be connected and having a tensile strength greater than the tubing in which it is to be connected, and a tubing connection threadedly connected to each end of the tubular member, packing means surrounding said body, expander means positioned below said packing means and surrounding said body and longitudinally movable on said body, coacting wedge surfaces between the lower end of the packing means and the upper end of the expander means for expanding the packing means outwardly upon relative movement of the expander means towards the packing means, slip means positioned about the body and adjacent the lower end of the expander means, second coacting wedge surfaces between said expander means and said slip means for expanding the slip means outwardly upon relative movement of the slip means towards the expander means, piston means positioned about the body and longitudinally movable on said body whereby upward movement of the piston expands the slip means and said packing means, port means in the body providing a fluid passageway between the interior of the body and the bottom of the piston whereby the piston may be actuated upwardly by the application of fluid pressure, and means in engagement with said piston means yieldably urging said piston means in a downwardly direction.

3. A well packer for connection in a well tubing comprising, a body, said body including a cylindrical integral member having two parallel fluid bores each having an internal diameter as great as the tubing to which each is to be connected and said member having a tensile strength greater than the tubings to which it is to be connected, and a tubing connection connected to each passageway at each end of the cylindrical member, packing means surrounding said body, expander means positioned below said packing means and surrounding said body and longitudinally movable on said body, coacting wedge surfaces between the lower end of the packing means and the upper end of the expander means for expanding the packing means outwardly upon relative movement of the expander means towards the packing means, slip means positioned about the body and adjacent the lower end of the expander means, second coacting wedge surfaces between said expander means and said slip means for expanding the slip means outwardly upon relative movement of the slip means towards the expander means, piston means positioned about the body and longitudinally movable on said body whereby upward movement of the piston expands the slip means and said packing means, port means in the body providing a fluid passageway between the interior of the body and the bottom of the piston whereby the piston may be actuated upwardly by the application of fluid pressure, and means in engagement with said piston means yieldably urging said piston means in a downwardly direction.

4. A well packer for connection in a well tubing comprising, a tubular body having an internal diameter as great as the tubing in which it is to be connected and having a tensile strength greater than the tubing in which it is to be connected, a tubing connection secured to each end of the body, resilient packing means secured to and surrounding the body, expander means positioned below said packing means about the body and mounted on the body for limited longitudinal movement, coacting wedge surfaces between the lower end of the packing means and the upper end of the expander means for expanding the packing means outwardly upon relative movement of the expander means toward the packing means, slip means positioned about the body and adjacent the lower end of the expander means, second coacting wedge surfaces between said expander means and said slip means for expanding the slip means outwardly upon relative movement of the slip means towards the expander means, piston means positioned about the body and longitudinally movable on said body whereby upward movement of the piston expands the slip means and said packing means, port means in the body providing a fluid passageway between the interior of the body and the bottom of the piston whereby the piston may be actuated upwardly by the application of fluid pressure in the body, and spring means positioned about the body above the piston means yieldably urging said piston downwardly whereby the packer may be released from a set position and reset in the well.

5. A well packer for connection in a well tubing comprising, a cylindrical integral body having two parallel fluid bores, each having an internal diameter as great as the tubing to which each is to be connected and said body having a tensile strength greater than the tubings to which it is to be connected, a tubing connection connected to each bore at each end of the body, resilient packing means secured to and surrounding the body, expander means positioned below said packing means about the body and mounted on the body for limited longitudinal movement, coacting wedge surfaces between the lower end of the packing means and the upper end of the expander means for expanding the packing means outwardly upon relative movement of the expander means towards the packing means, slip means positioned about the body and adjacent the lower end of the expander means, second coacting wedge surfaces between said expander means and said slip means for expanding the slip means outwardly upon relative movement of the slip means towards the expander means, piston means positioned about the body and longitudinally movable on said body whereby upward movement of the piston expands the slip means and said packing means, port means in the body providing a fluid passageway between one of the parallel fluid bores and the bottom of the piston whereby the piston may be actuated upwardly by the application of fluid pressure, and spring means positioned about the body above the piston means yieldably urging said piston downwardly whereby the packer may set, released from a set position and reset in the well.

* * * * *